US009368012B2

(12) United States Patent
Saruwatari et al.

(10) Patent No.: US 9,368,012 B2
(45) Date of Patent: Jun. 14, 2016

(54) DETECTOR WITH INTEGRATED SENSOR PLATFORM

(71) Applicant: Life Safety Distribution AG, Morristown, NJ (US)

(72) Inventors: Tak G. Saruwatari, Calgary (CA); Mahdi Javer, Calgary (CA); Kelly A. F. Englot, Calgary (CA); Richard Ian King, Ferndown (GB)

(73) Assignee: Honeywell International Inc., Morris Plains, NJ (US)

( * ) Notice: Subject to any disclaimer, the term of this patent is extended or adjusted under 35 U.S.C. 154(b) by 73 days.

(21) Appl. No.: 14/197,531

(22) Filed: Mar. 5, 2014

(65) Prior Publication Data

US 2015/0084767 A1 Mar. 26, 2015

Related U.S. Application Data

(60) Provisional application No. 61/880,434, filed on Sep. 20, 2013.

(51) Int. Cl.

| | |
|---|---|
| ***G08B 19/00*** | (2006.01) |
| ***G08B 17/10*** | (2006.01) |
| ***G08B 17/12*** | (2006.01) |

(52) U.S. Cl.

CPC ..... *G08B 19/00* (2013.01); *G08B 17/10* (2013.01); *G08B 17/12* (2013.01)

(58) Field of Classification Search

CPC ..... G08B 19/00; G08B 17/10; G08B 17/12; G08B 21/12; G08B 21/182

See application file for complete search history.

(56) References Cited

U.S. PATENT DOCUMENTS

| | | | | |
|---|---|---|---|---|
| 2002/0158767 | A1* | 10/2002 | Nishikawa et al. | 340/577 |
| 2003/0020617 | A1* | 1/2003 | Tice | G08B 17/10 340/600 |
| 2005/0275528 | A1* | 12/2005 | Kates | 340/539.22 |
| 2006/0187017 | A1* | 8/2006 | Kulesz et al. | 340/506 |
| 2014/0077964 | A1* | 3/2014 | Beligere et al. | 340/853.3 |
| 2015/0235528 | A1* | 8/2015 | Ramer | G08B 5/36 340/517 |

FOREIGN PATENT DOCUMENTS

GB 2488375 A 8/2012

OTHER PUBLICATIONS

Extended European Search Report and European Search Opinion for corresponding EP application 14183468.9, dated Nov. 10, 2014.

* cited by examiner

*Primary Examiner* — Hongmin Fan

(74) *Attorney, Agent, or Firm* — Conley Rose, P.C.; Kristin Jordan Harkins

(57) ABSTRACT

An integrated system platform includes a sensor containing an embedded microcontroller and associated circuitry for providing safety critical functionality. Signal conditioning circuitry is coupled to the sensor along with gas concentration determining circuitry, alarm status circuitry and fault status evaluation circuitry. Wherein the sensor is operational with a main control module and at least one alarm output device.

11 Claims, 1 Drawing Sheet

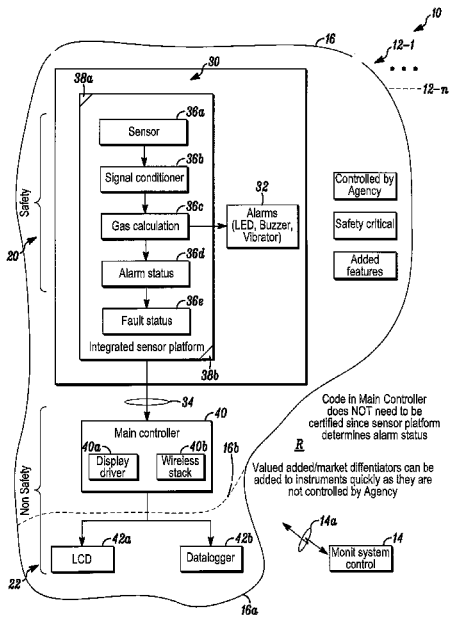

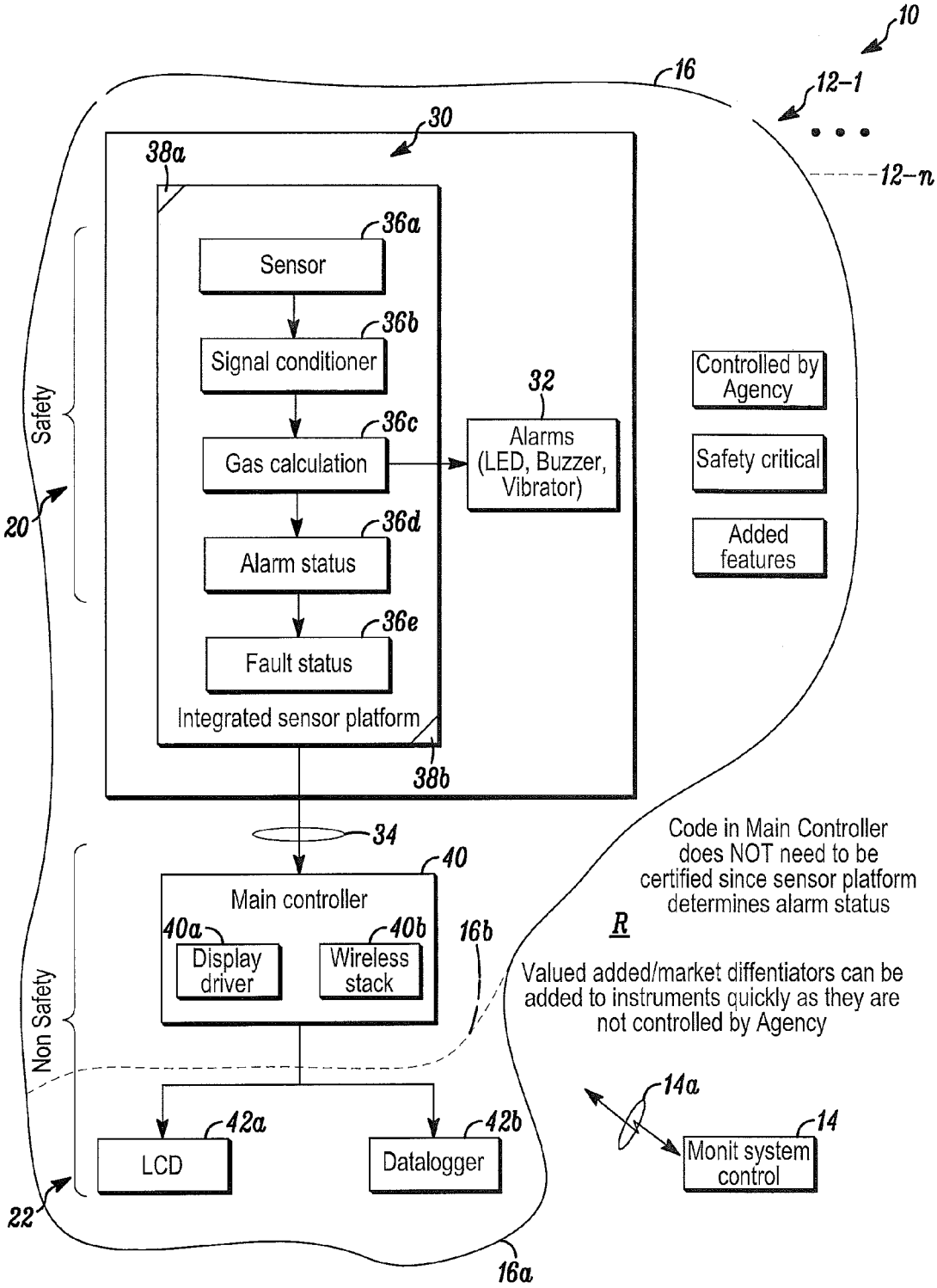
10
16
12-1
12-n
30
38a
36a
Sensor
36b
Signal conditioner
36c
Gas calculation
36d
Alarm status
36e
Fault status
Integrated sensor platform
38b
32
Alarms (LED, Buzzer, Vibrator)
Controlled by Agency
Safety critical
Added features
Safety
20
34
40
Main controller
40a
Display driver
40b
Wireless stack
16b
Code in Main Controller does NOT need to be certified since sensor platform determines alarm status
R
Valued added/market diffentiators can be added to instruments quickly as they are not controlled by Agency
Non Safety
14a
14
Monit system control
42a
LCD
42b
Datalogger
22
16a

DETECTOR WITH INTEGRATED SENSOR PLATFORM

CROSS-REFERENCE TO RELATED APPLICATION

This application claims the benefit of the filing date of U.S. Provisional Application Ser. No. 61/880,434 filed Sep. 20, 2013, entitled, "Integrated Sensor Platform". The '434 application is hereby incorporated herein by reference.

FIELD

The application pertains to gas or smoke detectors. More particularly, the application pertains to portable detectors which include standardized sensing modules which have been certified by an agency, and, are usable with different peripheral circuits without loss of that certification.

BACKGROUND

Portable gas detectors are being subjected to ever more rigorous regulatory performance certifications. Some of these performance approvals now include a software evaluation. This evaluation typically means that all software in the detector is evaluated and then controlled by an agency from that point forward. This level of control makes it very difficult to make changes or add features to existing designs.

Such regulatory involvement can increase the time needed to commercialize and market new detectors and features, which in turn can lead to a competitive disadvantage in the marketplace. In addition to software certifications, detectors are also usually subject to regulatory evaluations of the hardware that is used to implement gas sensing circuitry. Thus, even if a sensor has been previously certified to a particular performance standard, each new instrument use requires recertification. This process can result in further increased delays with regard to the launch cycle of new products.

BRIEF DESCRIPTION OF THE DRAWINGS

FIG. 1 illustrates a block diagram of a system in accordance herewith.

DETAILED DESCRIPTION

While disclosed embodiments can take many different forms, specific embodiments thereof are shown in the drawings and will be described herein in detail with the understanding that the present disclosure is to be considered as an exemplification of the principles thereof as well as the best mode of practicing same, and is not intended to limit the application or claims to the specific embodiment illustrated.

It will be recognized by persons of ordinary skill in the art that embodiments hereof provide a new platform that can reduce the development time by eliminating much of the evaluation performed by regulatory agencies. Generally, embodiments disclosed herein are able to satisfy this objective by providing a novel sensor and method that can determine alarm conditions of a particular gas channel. This process can generally involve calculating a final gas reading; determining high and low alarms; determining fault conditions for the sensor, and providing an alarm indication.

Such embodiments are able to carrying out this process without intervention from the main controller and thus can be considered as a separate safety critical subsystem. This process can enable the safety critical functionality to be contained within a sensor module such that a main processor of a respective detector, responsible for driving the output display device, for example a liquid crystal display device (LCD), as well as any other value added functions, does not need to be evaluated to the same level as the safety critical portion.

Thus, a self-contained sensing element as described herein can become a platform around which instrument families, which can include various types of detectors, can be designed. It will be recognized that this configuration can save anywhere from six months to a year on each new development cycle and can also enable incremental changes and updates to be made to the subject detectors without each change requiring an update to the performance evaluation. Such benefits are at least in part due to the fact that embodiments hereof can be partitioned into safety/non-safety blocks, or modules, which can provide flexibility and simplification of the agency requirements for value added features. These embodiments can provide important advantages in the market by enabling users to respond more quickly to customer requests and expectations.

The Integrated Sensor Platform described herein can be implemented by embedding a programmable processor, such as a micro controller, into the sensor. This controller can perform a series of functions, including converting an analog signal from the sensor to final measurement units, comparing this measured value to stored alarm setpoints, determining fault conditions for the sensor, determining high/low alarm conditions, driving high and low alarms with dedicated output pins, providing a fault status signal via a dedicated output pin, communicating sensor readings to the main controller for display on the LCD, and incorporating the necessary hardware to perform self-diagnostics and prevent runaway conditions.

FIG. 1 illustrates a system 10 in accordance herewith. As those of skill will understand, system 10 functions to monitor one or more ambient conditions in region R. For example, system 10 might include a plurality of detectors 12, as discussed below, scattered throughout the region R. As described, the detectors 12-*i* advantageously separate circuitry which carries out functions related to safety, and must be certified by an appropriate Agency, from non-safety related circuits which do not need certification and are not subject to Agency control.

The detectors 12-*i* can communicate via a wired or wireless medium 14*a* with a monitoring system control unit 14.

Detector 12-1 is representative of the members of the plurality of detectors 12. Hence, a discussion of detector 12-1 will apply to remaining members of the plurality 12.

As illustrated in FIG. 1, a housing 16 carries various elements of detector 12-1. As explained below, housing 16 can readily be designed to carry more or less circuitry, hence functionality, without a need for additional certifications. Other housing configurations come within the spirit and scope hereof.

Circuitry in housing 16 is partitioned into safety related components, or module, 20 and non-safety related circuitry, or module, 22. For example, safety related module 20 includes all agency controlled safety critical elements. These can be implemented as an integrated sensor platform 30 and an associated alarm indicator 32. Platform 30 and output device(s) 32 are interconnected, and platform 30 can provide outputs, 34 to non-safety elements 22.

A single housing is not required. Separate housings for each module type, 20, 22 can be provided. Both modules can be carried on a single substrate.

Platform 30 can include one or more sensor(s) 36*a*, which can include gas sensors, fire or smoke sensors, radiation sensors all without limitation. Signal conditioning circuitry 36*b*, gas or smoke level determination circuitry 36*c*, alarm status indicating circuitry 36*d*, and fault status indicting circuitry 36*e*. Circuits 36 can be implemented at least in part with a programmable processor, microcontroller 38*a*, and associated executable instructions 38*b*. Those of skill will understand that the instructions 38*b* can be installed in read only memory, read-write memory or any other configuration without departing from the spirit and scope hereof. Processor 38*a*, with instructions 38*b* can also drive the alarm indicating output devices such as light emitting diodes, buzzers or vibrators 32.

Since the sensor platform 30 determines alarm status, the non-safety module 22 does not need agency certification. As a result, users can readily specify or install variations on the circuitry therein.

Without limitation, the non-safety module 22 can include a programmable controller 40 which includes one or more display drivers 40*a*, and wireless communications circuitry 40*b*. The controller 40 can also be coupled to liquid crystal display 42*a*, and datalogger 42*b*. Advantageously, and, in accordance herewith, users can request versions of detector 12-1 that include the display 42*a* and datalogger 42*b* in the housing 16, or in a second, separate housing 16*a*, as indicted by housing dashed wall 16*b*. In either instance, the certified safety module 20 is not revised or altered, and no recertification will be required.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. A detector comprising:

a first sensor module comprising: a sensor and circuitry configured to provide at least one of gas, fire, smoke, or radiation sensing evaluation of potential alarm conditions in response to outputs from the sensor, and generation of at least one output indicator in response thereto in accordance with predetermined certification requirements, wherein the first sensor module comprises a first programmable processor and executable instructions carried in the first sensor module, wherein the first programmable processor and the executable instructions are configured to provide output signals to drive local output devices located in the first sensor module; and a second module which is coupled to the sensor module and which provides different, uncertified functions, wherein the second module comprises a second programmable processor and a second executable instructions configured to provide the uncertified functions, and wherein the first sensor module and the second module are carried by a common support member.

2. The detector as in claim 1, wherein the first sensor module includes at least one of a gas sensor, a smoke sensor, a fire sensor, or a radiation sensor.

3. The detector as in claim 2, Wherein alarm evaluations are implemented by the first programmable processor and the executable control instructions carried in the first sensor module.

4. The detector as in claim 3, wherein the first programmable processor and the executable instructions are configured to process signals from the at least one sensor to compare a representation of those signals to a predetermined indicator of an alarm condition and produce an electrical signal indicative thereof.

5. The detector as in claim 2, wherein the first sensor module and the second module are carried in a single housing.

6. The detector as in claim 1, wherein additional functions can be implemented in the second module without altering certification of the sensor module.

7. A modular detector comprising:

a sensing module comprising at least one ambient condition sensor, and condition sensing and evaluating circuitry coupled thereto, wherein the condition sensing and evaluating circuitry comprises a first programmable processor and executable control instructions, wherein a configuration and performance of the executable control instructions pertains to regulated, safety issues, wherein the first programmable processor and the executable control instructions are configured to provide output signals to drive local output devices located in the first sensor module; and an electronic module coupled to the sensing module comprising a second programmable processor and second executable control instructions configured to perform functions that do not pertain to regulated safety issues, wherein the first sensor module and the second module are carried by a common support member;

wherein the electronic module is separately modifiable independently of the sensing module without altering a certification status of the sensing module.

8. The detector as in claim 7, wherein the condition sensing and evaluating circuitry is configured to evaluate signals from the at least one ambient condition sensor to determine the presence of an alarm condition.

9. The detector as in claim 8, wherein the electronic module is configured to receive an indicia of a detected alarm condition from the sensing mod We, and transmit the indicia to a displaced location.

10. The detector as in claim 9, wherein the electronic module comprises at least one of a display driver as well as communications circuitry.

11. The detector as in claim 7, wherein the at least one ambient condition sensor is selected from a class which includes at least one of a gas sensor, a smoke sensor, a fire sensor, and a radiation sensor.

* * * * *